US011530111B2

(12) United States Patent
Bullock et al.

(10) Patent No.: US 11,530,111 B2
(45) Date of Patent: Dec. 20, 2022

(54) CORD MANAGEMENT APPARATUS

(71) Applicant: KOG LLC, Lehi, UT (US)

(72) Inventors: Bridger Max Bullock, Lehi, UT (US); Kellan James Cutler, Providence, UT (US); Trevor Jay Nielsen, Lehi, UT (US)

(73) Assignee: ZIGGURAT PRODUCTS, LLC, Centerville, UT (US)

( * ) Notice: Subject to any disclaimer, the term of this patent is extended or adjusted under 35 U.S.C. 154(b) by 987 days.

(21) Appl. No.: 16/271,504

(22) Filed: Feb. 8, 2019

(65) Prior Publication Data

US 2019/0248622 A1 Aug. 15, 2019

Related U.S. Application Data

(60) Provisional application No. 62/628,674, filed on Feb. 9, 2018.

(51) Int. Cl.
*B65H 75/48* (2006.01)
*B65H 75/44* (2006.01)

(52) U.S. Cl.
CPC ..... *B65H 75/486* (2013.01); *B65H 75/4431* (2013.01); *B65H 75/4471* (2013.01)

(58) Field of Classification Search
CPC .. B65H 75/48; B65H 75/486; B65H 75/4431; B65H 75/4471
See application file for complete search history.

(56) References Cited

U.S. PATENT DOCUMENTS

| | | | | |
|---|---|---|---|---|
| 5,354,011 | A * | 10/1994 | Rozon | E06B 9/32 242/402 |
| 5,762,281 | A * | 6/1998 | Foley | B65H 75/44 242/376 |
| 5,791,580 | A * | 8/1998 | Anderson | E06B 9/326 242/381.3 |
| 5,916,658 | A * | 6/1999 | Mohr | F16N 31/006 180/69.1 |
| 6,681,831 | B1 * | 1/2004 | Cheng | E06B 9/322 160/172 R |
| 7,156,338 | B2 * | 1/2007 | Schartner | E06B 9/326 160/178.1 R |
| 9,476,253 | B2 * | 10/2016 | Lai | E06B 9/322 |
| 2005/0145739 | A1 * | 7/2005 | Warren | B65H 75/48 242/378.3 |

* cited by examiner

*Primary Examiner* — Sang K Kim
(74) *Attorney, Agent, or Firm* — Snell & Wilmer L.L.P.

(57) ABSTRACT

A cord management apparatus includes a housing, a reel rotatably disposed within the housing, and a button operably coupled to the reel and configured to control extension and retraction of a window blind cord attached to the reel, according to various embodiments. The housing may include a back portion and a front portion. The front portion may be at least one of detachably and pivotally coupled to the back portion such that the housing is openable to allow a user to have access to an internal chamber defined by the housing.

5 Claims, 3 Drawing Sheets

CORD MANAGEMENT APPARATUS

CROSS-REFERENCE TO RELATED APPLICATIONS

This application claims priority to U.S. provisional patent application Ser. No. 62/628,674, filed on Feb. 9, 2018, the entire contents of which are incorporated herein by reference in their entirety.

FIELD

The present disclosure relates to a safety device, and more particularly to a window blind cord management apparatus.

BACKGROUND

Window blind cords have been known to cause injuries and strangulations of children and animals. The greatest risk occurs when window blinds are pulled open and excess lengths of cord are made accessible, often dangling down near or onto the ground. While there are a variety of conventional solutions that aim to help prevent injury or death to small children and pet animals from window blind cords, these conventional solutions are often cumbersome and unsightly. For example, some conventional devices leave the window blind cords exposed, others require the user to manually wind the cords, and other are difficult and/or time consuming to install.

SUMMARY

In various embodiments, the present disclosure provides a cord management apparatus. The cord management apparatus includes a housing, a reel rotatably disposed within the housing, and a button operably coupled to the reel and configured to control extension and retraction of a window blind cord attached to the reel, according to various embodiments. The housing may include a back portion and a front portion. The front portion may be at least one of detachably and pivotally coupled to the back portion such that the housing is openable to allow a user to have access to an internal chamber defined by the housing.

In various embodiments, the back portion of the housing has a post that extends from an inner surface of the back portion, wherein the reel comprises a central hole such that the post is insertable into the central hole of the reel. In various embodiments, the cord management apparatus further includes a spring operably disposed between and coupled between the housing and the reel, wherein the spring is configured to exert a rotational bias on the reel.

In various embodiments, the post defines a slit, the reel comprises a bottom portion that defines a cavity, the spring is disposed within the cavity of the reel, the spring comprises a first end and a second end, the first end of the spring is coupled to the slit of the post, and the second end of the spring is coupled to the reel. In various embodiments, the spring is a first spring, the cord management apparatus further comprises a second spring, the second spring is coupled between the post of the housing and the button, the front portion of the housing comprises a rim that defines an opening, and the button is disposed in the opening and at least partially protrudes therefrom.

In various embodiments, the button comprises a protruding ridge extending around the button, the button defines a central channel that fits around and engages the post such that the button is prevented from rotating about the post, and the second spring is coupled to the post and is configured to bias the button outward such that the protruding ridge is biased against an inside edge of the rim that defines the opening. In various embodiments, the reel comprises one or more first tabs that extend radially inward and the button comprises one or more second tabs that extend radially outward. In response to depression of the button, and corresponding compression of the second spring, the one or more first tabs are misaligned with the one or more second tabs, thereby allowing rotation of the reel relative to the housing, according to various embodiments. In response to the button being in a non-depressed state, the one or more first tabs are aligned with and engage the one or more second tabs to prevent rotation of the reel relative to the housing, according to various embodiments.

In various embodiments, the cord management apparatus further includes a connector coupled to the reel, wherein the connector is configured to be coupled to a window blind cord. In various embodiments, the connector comprises a flexible material that may at least partially bend/extend around the reel. In various embodiments, the connector comprises a connection interface to which the window blind cord is configured to be coupled. In various embodiments, the cord management apparatus further includes a feature that prevents retraction of the connection interface within the housing.

The forgoing features and elements may be combined in various combinations without exclusivity, unless otherwise expressly indicated herein. These features and elements, as well as the operation of the disclosed embodiments, will become more apparent in light of the following description and accompanying drawings.

Figure 1:
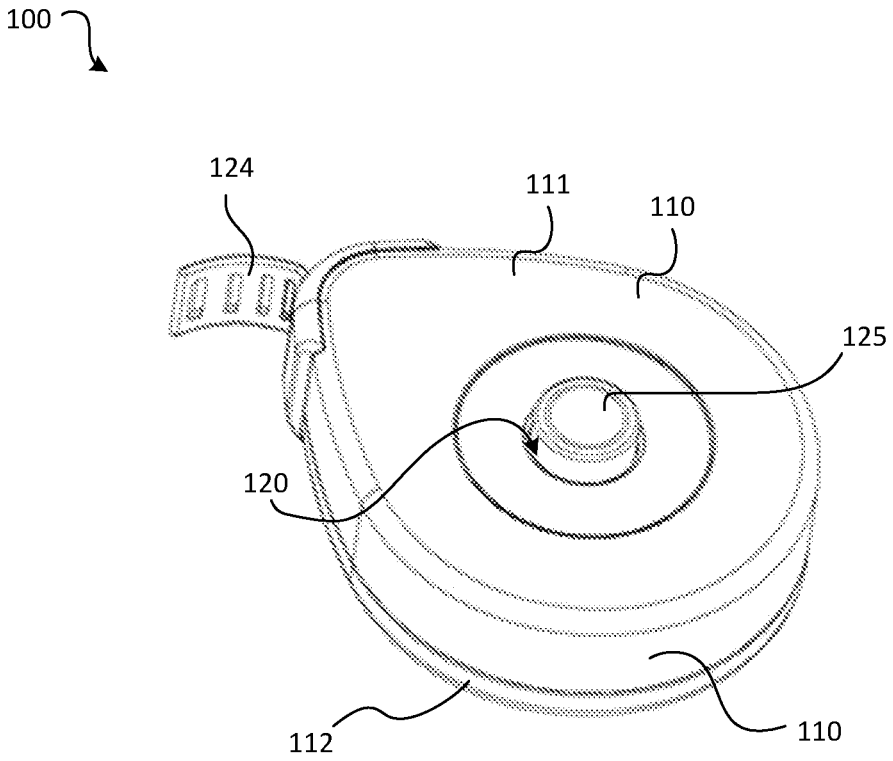
FIG. 1 is a perspective view of a cord management device, according to various embodiments.
Figure 2A:
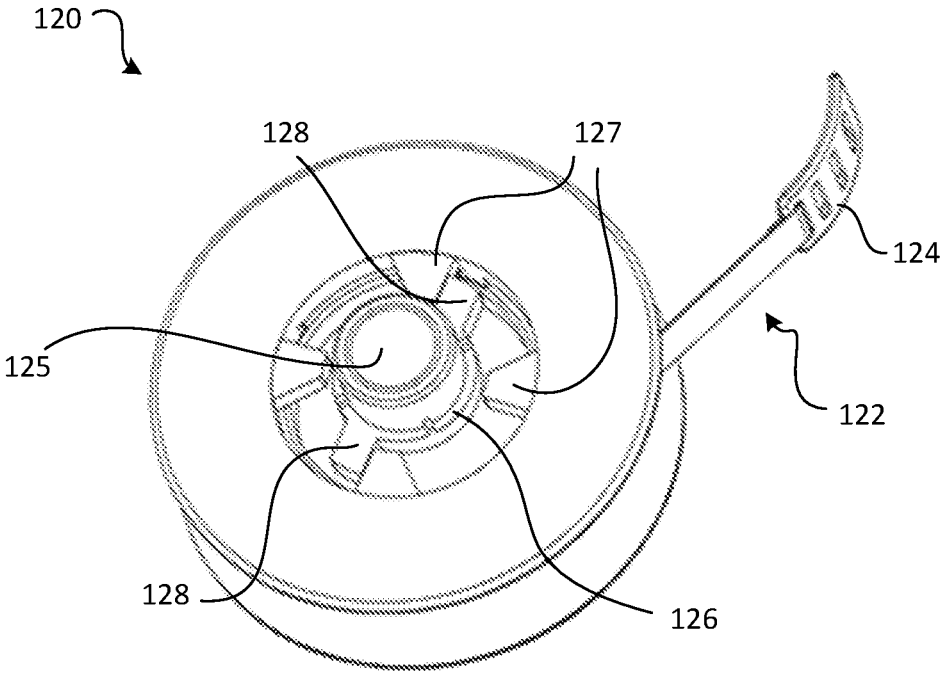
FIG. 2A is a perspective view of a reel of a cord management device, according to various embodiments.
Figure 2B:
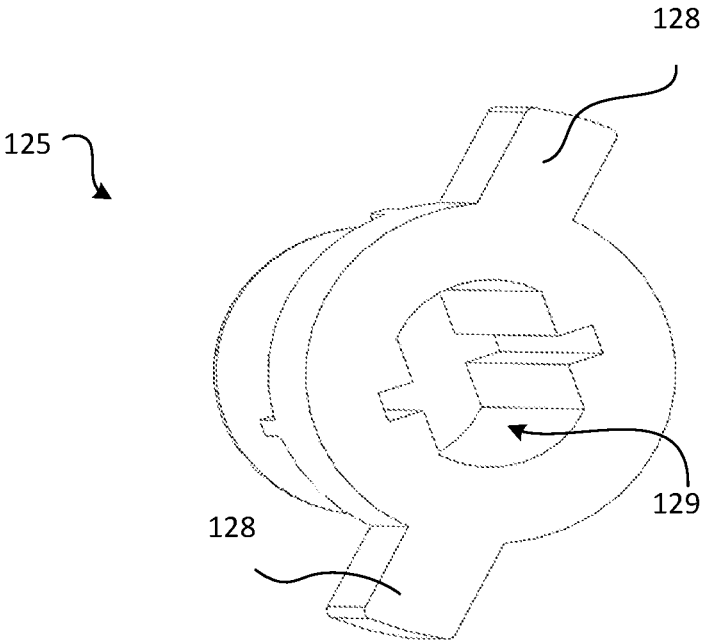
FIG. 2B is a perspective view of a button a cord management device, according to various embodiments.
Figure 3A:
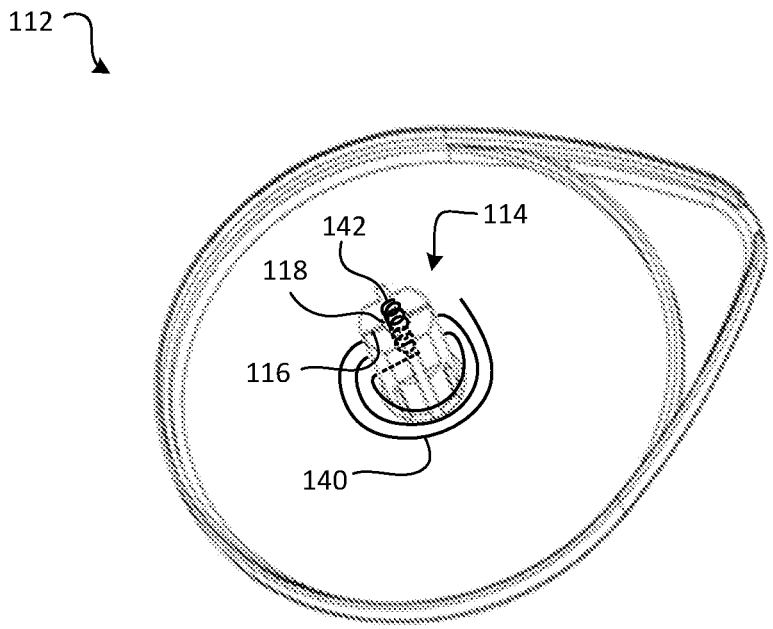
FIG. 3A is a perspective view of a portion of a housing of a cord management device, according to various embodiments.
Figure 3B:
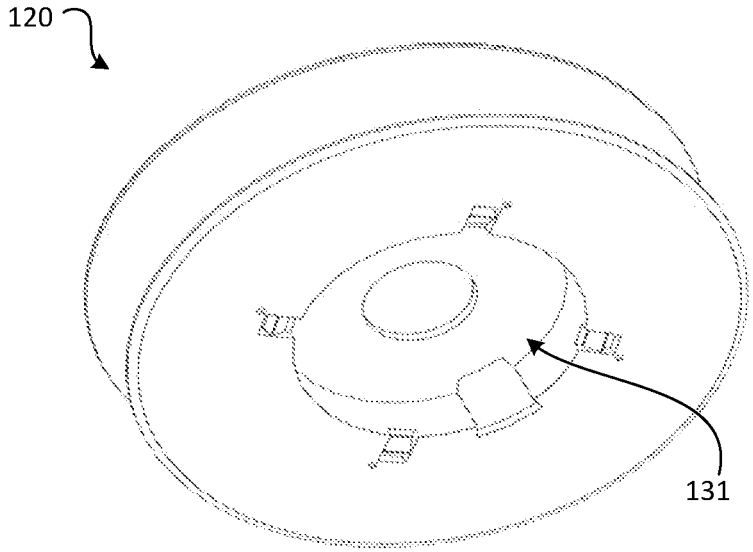
FIG. 3B is a perspective view of a bottom side of a reel of a cord management device, according to various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

In various embodiments, and with reference to FIG. 1, a cord management apparatus 100 is disclosed. Although numerous details, figures, and examples are provided herein pertaining to using the cord management apparatus for window blind cords, the scope of the present disclosure is not necessarily thus limited. That is, the cord management apparatus 100 may also be utilized to hold, retain, organize, or otherwise manage cords, string, rope, wires, etc. Generally, the cord management apparatus 100 includes a housing 110 and a reel 120 disposed within the housing 110. The cord management apparatus 100, according to various embodiments, is configured to attach to a window blind cord and reversibly retract the window blind cord into the cord management apparatus 100. In various embodiments, as described in greater detail below, the cord management apparatus 100 may further include a button 125 or other user interface operably coupled to the reel 120 such that retraction and extension of the window blind cord relative to the housing 110 of the cord management apparatus 100 is performed in response to a user actuating the button 125.

In various embodiments, and with reference to FIGS. 1, 2A, 2B, 3A, and 3B, the housing 110 may be a casing or other shell-like structure that defines an internal chamber within which the reel 120 is disposed. The housing 110 may be made from multiple sections, such as a front portion 111 and a back portion 112 that may be coupled together to define the internal chamber. For example, the housing 110 may include sections/portions that are coupled together using fasteners, such as screws, bolts, etc., or the sections/portions of the housing 110 may be pivotally coupled together using one or more hinge mechanisms, thereby enabling a user to easily access the internal chamber of the housing 110, as needed.

The reel 120 may be rotatably coupled to the housing 110, thereby enabling relative rotation between the reel 120 and the housing 110. In various embodiments, and with reference to FIG. 3A, a portion of the housing 110, such as a back portion 112, may have a post 114 that extends from an inner surface of the back portion 112 of the housing 110 and partially into the central chamber defined by the housing 110. The reel 120 may define a central hole that fits around the post 114, thus enabling the reel 120 to rotate about the post 114 during operation.

In various embodiments, the cord management apparatus 100 further includes a spring 140 or other biasing mechanism. The spring 140 (also referred to herein as a first spring) may be attached to the reel 120 and may be operably coupled between the reel 120 and the housing 110 to exert a rotational bias on the reel 120. In various embodiments, and with momentary reference to FIGS. 3A and 3B, one end of the power spring 140 is inserted into a slit 116 in the post 114 and the remainder of the power spring is coiled within a cavity 131 defined in a central bottom portion the reel or spindle 120. The post 114 protrudes from the shell or casing inwardly. A compression spring 142 (also referred to herein as a second spring) fits into a cavity 118 at the center of the post.

The cord management apparatus 100 may include a connector 122 that is coupled to the reel 120, according to various embodiments. The connector 122 may be a portion of the reel 120, or the connector 122 may be a component that is attached to/mounted to the reel 120. For example, one end of the connector 122 may be affixed to the reel 120 while the other end is configured to be attached to a window blind cord. The connector 122, according to various embodiments, is a flexible material that may extend at least partially around the reel 120. In various embodiments, the connector 122 is a flexible strap-like element.

In various embodiments, the connector 122 may include a connection interface 124 that enables and/or facilitates a connection between the window blind cord and the connector 122 of the cord management apparatus 100. In various embodiments, the connection interface 124 may include openings or slits to which users may fasten window blind cords. In various embodiments, the connection interface 124 may include a clip, ring, hook, or other such structure that enables a user to easily and reversibly attach a window blind cord thereto. The cord management apparatus 100 may include a clip, feature, or other structure that prevents the connector 122 from inadvertently retracting completely into the internal chamber of the housing 110 until/unless a window blind cord is attached thereto.

In various embodiments, rotation of the reel 120 may be controlled via a button 125 or other such user interface. That is, extension and retraction of the window blind cord may be controlled/actuated using button 125. In various embodiments, the housing 110 defines an opening and button 125 may be generally disposed within the hole and may at least partially protrude therefrom to allow a user to easily interact with the button 125 to control the cord management apparatus 100. In various embodiments, and with momentary reference to FIGS. 2A and 2B, the button 125 has a protruding ridge 126 that extends around the outer surface of the shaft of the button 125 and defines an opening 129 on the inside edge which allows said button to fit over the post 114 and slide up and down on the said post 114. The compression spring presses the protruding ridge 126 around the outside of the button against the inner rim of a hole in the shell or casing 110. On the opposite side of the reel or spindle from the power spring, a hollow cavity exists with first tabs 127 that jut radially inward toward the post 114. Second tabs 128 extending radially outward from the side walls of the button 125 engage with the first tabs 127 on the spindle to keep the spindle from spinning. Once the button is pressed, the second 128 tabs move out of direct alignment with the first tabs 127 and the spindle 120 is free to spin. The connector piece 124 attaches to the spindle 120 via a strip of flexible material 122. When the button 125 is pressed, blind cords wind around the spindle. The shell or casing 110 has two holes—one through which the blind cords enter the device and wrap around the reel or spindle; and one through which the button protrudes.

In various embodiments, the cord management apparatus 100 disclosed herein provides various benefits over conventional devices. For example, the cord management apparatus 100 disclosed herein does not require the window blind cords to be permanently altered, according to various embodiments. Also, the cord management apparatus 100 effectively conceals the window blind cords, is aesthetically pleasing, and serves as a handle/knob for users to grasp to open and/or close the blinds.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

Reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cord management apparatus comprising:

a housing, wherein the housing comprises a back portion and a front portion such that the housing is openable to allow a user to have access to an internal chamber defined by the housing;

a reel rotatably disposed within the housing, wherein the reel comprises one or more first tabs that extend radially inward;

a first spring operably disposed between and coupled between the housing and the reel, wherein the first spring is configured to exert a rotational bias on the reel;

a button operably coupled to the reel and configured to control extension and retraction of a window blind cord attached to the reel, wherein the button comprises one or more second tabs that extend radially outward; and a second spring coupled between the post of the housing and the button;

wherein:

the back portion of the housing comprises a post that extends from an inner surface of the back portion, the reel comprises a central hole such that the post is insertable into the central hole of the reel;

the post defines a slit;

the reel comprises a bottom portion that defines a cavity, the first spring is disposed within the cavity of the reel;

the first spring comprises a first end and a second end, the first end of the first spring is coupled to the slit of the post, and the second end of the first spring is coupled to the reel;

the front portion of the housing comprises a rim that defines an opening, the button is disposed in the opening and at least partially protrudes therefrom;

the button comprises a protruding ridge extending around the button;

the button defines a central channel that fits around and engages the post such that the button is prevented from rotating about the post;

the second spring is coupled to the post and is configured to bias the button outward such that the protruding ridge is biased against an inside edge of the rim that defines the opening;

in response to depression of the button, and corresponding compression of the second spring, the one or more first tabs are misaligned with the one or more second tabs, thereby allowing rotation of the reel relative to the housing; and in response to the button being in a non-depressed state, the one or more first tabs are aligned with and engage the one or more second tabs to prevent rotation of the reel relative to the housing.

2. The cord management apparatus of claim 1, further comprising a connector coupled to the reel, wherein the connector is configured to be coupled to the window blind cord.

3. The cord management apparatus of claim 2, wherein the connector comprises a flexible material that may at least partially bend/extend around the reel.

4. The cord management apparatus of claim 3, wherein the connector comprises a connection interface to which the window blind cord is configured to be coupled.

5. The cord management apparatus of claim 1, wherein the front portion is detachably coupled to the back portion such that the housing is openable to allow the user to have access to the internal chamber defined by the housing.

* * * * *